US007575465B2

(12) United States Patent
Hanks

(10) Patent No.: US 7,575,465 B2
(45) Date of Patent: Aug. 18, 2009

(54) WIRE AND CABLE INSULATION MARKINGS FOR CONNECTOR TERMINATION

(75) Inventor: Rip Hanks, Gulf Breeze, FL (US)

(73) Assignee: Centerpin Technology, Inc., Gulf Breeze, FL (US)

( * ) Notice: Subject to any disclaimer, the term of this patent is extended or adjusted under 35 U.S.C. 154(b) by 133 days.

(21) Appl. No.: 11/692,856

(22) Filed: Mar. 28, 2007

(65) Prior Publication Data

US 2007/0149033 A1 Jun. 28, 2007

Related U.S. Application Data

(63) Continuation-in-part of application No. 11/420,646, filed on May 26, 2006, now Pat. No. 7,226,308.

(51) Int. Cl.
*H01B 7/36* (2006.01)
*H01R 11/00* (2006.01)

(52) U.S. Cl. ..... 439/427; 174/112; 439/488

(58) Field of Classification Search ..... 439/488, 439/427–429; 174/112; 29/863, 867; 385/100, 385/114

See application file for complete search history.

(56) References Cited

U.S. PATENT DOCUMENTS 4,288,311 A * 9/1981 Singleton et al. ..... 204/279
4,763,411 A * 8/1988 Takeshita ..... 29/863
5,775,934 A 7/1998 McCarthy
6,148,130 A * 11/2000 Lee et al. ..... 385/100
6,848,934 B1 2/2005 McCarthy

OTHER PUBLICATIONS

"SmartWire Cable Management—Security / Access Control Shielded Plenum Cable", Windy City Wire Cable & Technology Products, LLC, Jun. 7, 2007, downloaded from www.smartwire.com/partnumber.aspx?id=ba.

* cited by examiner

*Primary Examiner*—Neil Abrams
(74) *Attorney, Agent, or Firm*—Momkus McCluskey, LLC; Jefferson Perkins

(57) ABSTRACT

Insulated conductors, of either the wire or multistranded cable variety, are provided with a series of markings or visual indicators along their length on their insulation jackets. The markings include cut markings to show where the conductor is to be cut and, spaced from respective ones of the cut markings by a predetermined insertion depth, insertion markings to show a correct depth of insertion into an associated electrical connector receptacle. Depending on the type of connector for which the conductor is being furnished, the markings may further include a plurality of strip markings, spaced from respective ones of the cut markings by a predetermined strip length, and/or a plurality of final insertion markings, which are spaced from respective ones of the initial insertion markings by a predetermined connector cap compression stroke.

34 Claims, 6 Drawing Sheets

WIRE AND CABLE INSULATION MARKINGS FOR CONNECTOR TERMINATION

RELATED APPLICATIONS

This application is a continuation in part of copending U.S. patent application Ser. No. 11/420,646 filed 26 May 2006, owned by the assignee hereof, and the specification and drawings of which are fully incorporated by reference herein.

BACKGROUND OF THE INVENTION

It is known in the art to provide electrical connectors for insulated wire and insulated multistranded cable. In some circumstances the connector requires a terminal length of the cable or wire to be stripped of its insulation, while in others the connector can effect a good electrical connection without the stripping of the insulation.

Many connectors, including those provided by the assignee hereof and others, have a component into which a wire or cable end is inserted, typically a bore or other receptacle in a female connector body. Heretofore, the installer has had to guess whether the insulated wire or cable has been inserted into the connector body by the correct depth; it is often the case that the insulated conductor is not inserted into the connector far enough, or is inserted into the connector too far. Either way, and dependent on the particular connector design, the result may be a less than optimum connection in terms of electrical conduction, protection of a stripped end from the environment and physical strain relief.

Similarly there has been heretofore no clear guide, intrinsic to the components themselves, as to how far an end of an insulated conductor should be stripped prior to connection; the installer often has to refer to a separate printed instruction, which might tell him or her to strip off ¼ inch, ½ inch, or some other amount, and other times the installer simply guesses. The resultant variation in stripped lengths causes variability in how good the physical and electrical connections are, and how well the conductor is protected from the environment. If the installer strips the conductor too far, he or she will often have to cut the conductor again and restrip the end, causing waste in materials and time. A need therefore persists for methods and apparatus for cutting, stripping and connecting insulated conductors to connectors and equipment terminals, identically time and time again, so as to minimize installer error.

SUMMARY OF THE INVENTION

According to one aspect of the invention, an insulated conductor, of either the solid-wire or multistranded cable type, is provided in kit form with an electrical connector adapted to terminate it. The connector includes a receptacle into which the conductor is inserted. This bore or receptacle defines an optimum length or extent to which the conductor should be inserted into it. The insulation of the conductor has a plurality of cut markings on it, each indicating a place where the user may cut the conductor, and, spaced from respective ones of the cut markings, a plurality of insertion markings. An insertion marking is always spaced from a corresponding cut marking by a predetermined insertion length, chosen as a function of the optimum insertion depth of the connector receptacle. In operation, the user chooses one of the cut markings to cut the conductor to a length suitable for the connection task, and compares the next adjacent insertion marking to a predetermined reference as a guide to determine how far to insert the cut, free end of the conductor into the receptacle.

In one illustrated embodiment, the cut markings are the same as the insertion markings, and are uniformly spaced apart by the predetermined insertion length. In those embodiments in which the connector is of the type which can receive a stripped conductor end, there is further provided a plurality of strip markings, each strip marking spaced from a respective cut marking by a predetermined strip length. It is preferred that the cut markings and the strip markings be distinguishable from each other either visually or by touch.

In a further embodiment, the connector can be of the type which has a separate compression cap which moves relative to a connector body from a first position to a second position, the last position typically forcing the conductor into close contact with the conductive element of the connector. For example, the compression cap may screw on to the connector or may be linearly compressed, without twisting and parallel to the connector axis, from the first position to the second position. Kits according to the invention which have one or more such connectors in them preferably will have a length of insulated conductor which has been manufactured to display initial insertion markings (which preferably are the same as the cut markings) and final insertion markings, each final insertion marking uniformly spaced from a next adjacent initial insertion marking by a cap compression stroke. It is preferred that the initial and final insertion markings be distinguishable from each other by sight or touch. One of the final insertion markings is compared by the user against a predetermined reference (such as an axially outer face of the compression cap) to assure that a firm electrical connection has been obtained.

In certain embodiments, the conductor can have cut markings, initial insertion markings, final insertion markings and strip markings. It is preferred that the cut markings, the final insertion markings and the strip markings be distinguishable from each other by sight or touch.

Some conductor marking schemes permit the conductor to be marked in a uniform marking sequence from one end of the conductor to the other. Other marking schemes disclosed herein require that the conductor have a reflection point which divides the conductor into two parts, with a sequential marking order along the first part being the reverse of a sequential marking order on the second part.

In other forms of the invention, the conductor is furnished with markings as variously described, but not with connectors. Such conductors may be used with predetermined terminals built in to various electrical or electronic equipment or may be used with connectors of a predetermined type. The conductor can be of either the multistranded cable type or the solid core wire type.

The present invention furnishes kits, conductors and methods by which the electrical and physical conditions of termination can be replicated from one particular conductor end to the next, enhancing reliability and uniformity.

BRIEF DESCRIPTION OF THE DRAWINGS

Further aspects of the invention and their advantages can be discerned in the following detailed description, in which like characters denote like parts and in which.

DETAILED DESCRIPTION

Figures 1, 1A:
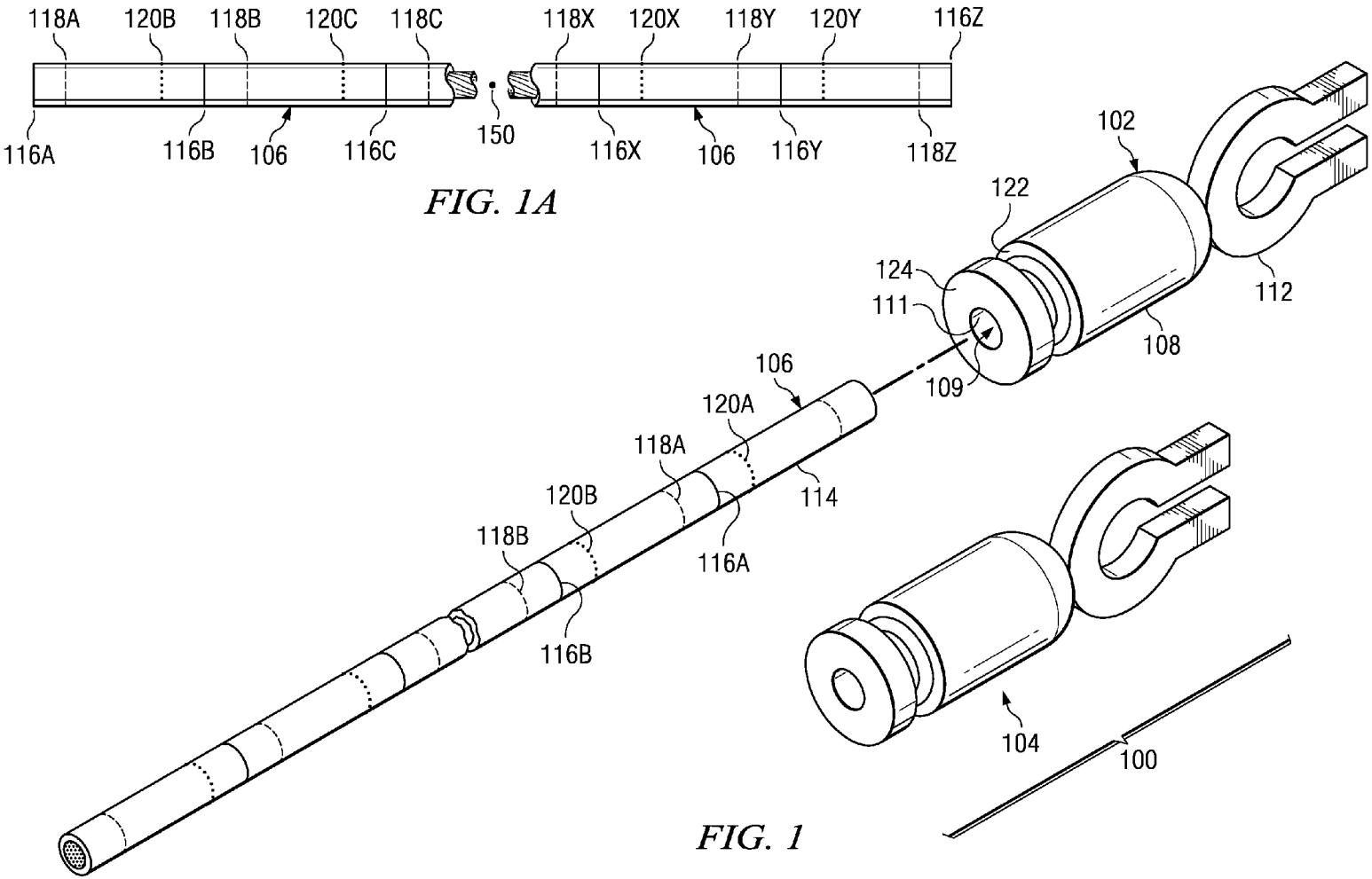
FIG. 1 is an isometric view of a first conductor and connector kit according to the invention.
FIG. 1A is a detail of the insulated conductor supplied with the kit shown in FIG. 1.

FIG. 1 shows a first kit 100 according to the invention, including identical end connectors 102 and 104 and a length of multistranded insulated conductor 106. Connector 102 is of the type which includes a body 108 having a bore therein (later described), a cap 110 which fits into an open end of the bore or receptacle, and a connector element 112, which in the illustrated embodiment is a battery terminal. Other connector elements can be employed, such as spade and pin connectors.

An insulation jacket 114 completely surrounds a conductive core of the conductor 106, except for the core's exposed ends. In this embodiment, an elongate, typically flexible cable 106 has a repeating series of three different markings on its insulation jacket 114: cut lines 116A, 116B . . . strip lines 118A, 118B . . . , and final insertion lines 120A, 120B . . . . The placement of these markings on the insulation jacket 114 will be determined by the structure of the connectors 102, 104 which are to terminate conductor 106. It is preferred that the markings 116, 118, 120 be distinguishable by the user from each other—either visually, as is illustrated here, or by touch (see FIGS. 2, 11 and 12). In FIG. 1, the cut lines 116 are solid circumferential lines in planes which are approximately orthogonal to the conductor axis, the strip lines 118 are rendered as dashed lines, and the final insertion lines 120 are rendered as lines of dots. These visual indicators could be in different colors and take different forms, and only some of the possibilities are illustrated herein.

As will be explained in more detail below, markings 116-120 are at predetermined distances from each other. The distance between a cut line (e.g., 116A) and a next adjacent strip line 118A is always a desired, predetermined strip length, or the length of the end of the conductor from which the insulation 114 is to be stripped. This strip length is preselected to best fit with the particular connector furnished with the kit. After a line 116 is selected for cutting the conductor 106, the user then use the next adjacent strip line 118 as an indicium to determine how far back from the cut end the insulation 114 is to be stripped.

To preserve material it is preferred (but it is not absolutely essential) that the distance between any one cut line (e.g., 116A) and the next adjacent cut line (e.g. 116B) be the same as the length of cable to be inserted into the receptacle of the connector 102, 104. This distance depends on the kind and size of connector furnished with the kit. Here, the distance between cut lines is the same as an initial insertion depth of the cable 106 into one of the connectors 102, 104. The initial insertion depth is composed of all or part of the depth of a bore or receptacle (not shown in this FIGURE) in female connector body 108, plus a distance by which the cap 110 (in a first position thereof) axially extends from an entrance 122 of the bore. In such an embodiment the cut lines 116 have two functions. When a cut line $\mathbf{116}_x$ is selected, the next cut line $\mathbf{116}_{x+1}$ will be used as an initial insertion line: the user lines up the line $\mathbf{116}_{x+1}$ with an outer end or face 124 of the cap 110 (in its first, uncompressed position, as shown) to assure that the end of conductor 106 has been inserted into the connector 102 far enough. More generally, the user uses initial insertion marking $\mathbf{116}_{x+1}$ as an indicium which is compared with a convenient reference to determine whether a correct amount of conductor 106 has been inserted into the connector receptacle. This provides a uniform connection and should make the connections so made more reliable in terms of electrical connection, insulation from the environment and strain relief.

The final insertion lines 120 are uniformly separated from respective next adjacent ones of the cut lines 116 (which also act as initial insertion lines) by a distance through which the cap 110 is to move into the bore of the female connector body 108 in completing the connection. When the user has advanced the cap 110 into the connector body bore far enough, such that the cap 110 is correctly and finally assembled to the body 108, the user will see one of the final insertion lines 120. This can be used by the user as a guide to determine whether the cap has been sufficiently advanced to effect a good electrical and physical connection.

In the illustrated kit forms, a user is given at least two connectors and a length of conductor 106 which will be long enough in most circumstances to connect together at least two terminals, electronic components, or the like. The user selects one of the marking sets $\mathbf{116}_x$, $\mathbf{118}_x$, $\mathbf{120}_x$ as an end to be connected via connector 102, and another one of the marking sets $\mathbf{116}_x$, $\mathbf{118}_x$, $\mathbf{120}_x$ as an end to be connected via connector 104. The user uses one or two of the cut lines $\mathbf{116}_x$ to cut the conductor 106 to the desired length. Different marking sets $\mathbf{116}_x$, $\mathbf{118}_x$, $\mathbf{120}_x$ are supplied to permit the user to cut conductor 106 to different lengths.

The conductor 106 supplied in the first kit 100 is shown in more detail in FIG. 1A. From a left end of the conductor, the markings proceed, left-to-right, in the order of cut marking 116, strip marking 118 and final insertion marking 120. But from the opposite, right end, the markings are in mirror-image order. In any one grouping there will be, right-to-left, a final insertion marking 120, a cut marking 116 and a strip marking 118. The marking sequence is reflected around some point 150 on the conductor 106, which can be near the middle of the conductor length but which may be chosen otherwise by the manufacturer. Generally, the conductor should have at least one left-to-right-going marking set such as the set composed of markings 120B, 116B and 118B, and at least one right-to-left-going marking set such as set 120Y, 116Y, 118Y. In the special case where the distance from a cut line 116 to a next adjacent final insertion line 120 is the same as the distance from that cut line to a next adjacent strip line 118, the conductor need not be marked in mirror image around point 150 but instead can use only two kinds of marks: a set of cut/initial insertion lines 116 uniformly spaced from each other along the conductor, and, flanking each cut/initial insertion line 116, a pair of strip/final insertion lines 120, 118, which don't even need to be visually distinguishable from each other.

Figure 2A:
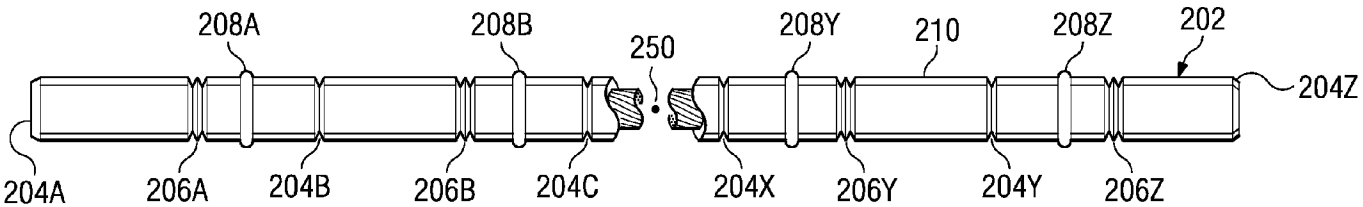
FIG. 2A is a detail of the insulated conductor supplied with the kit shown in FIG. 2.
Figure 2:
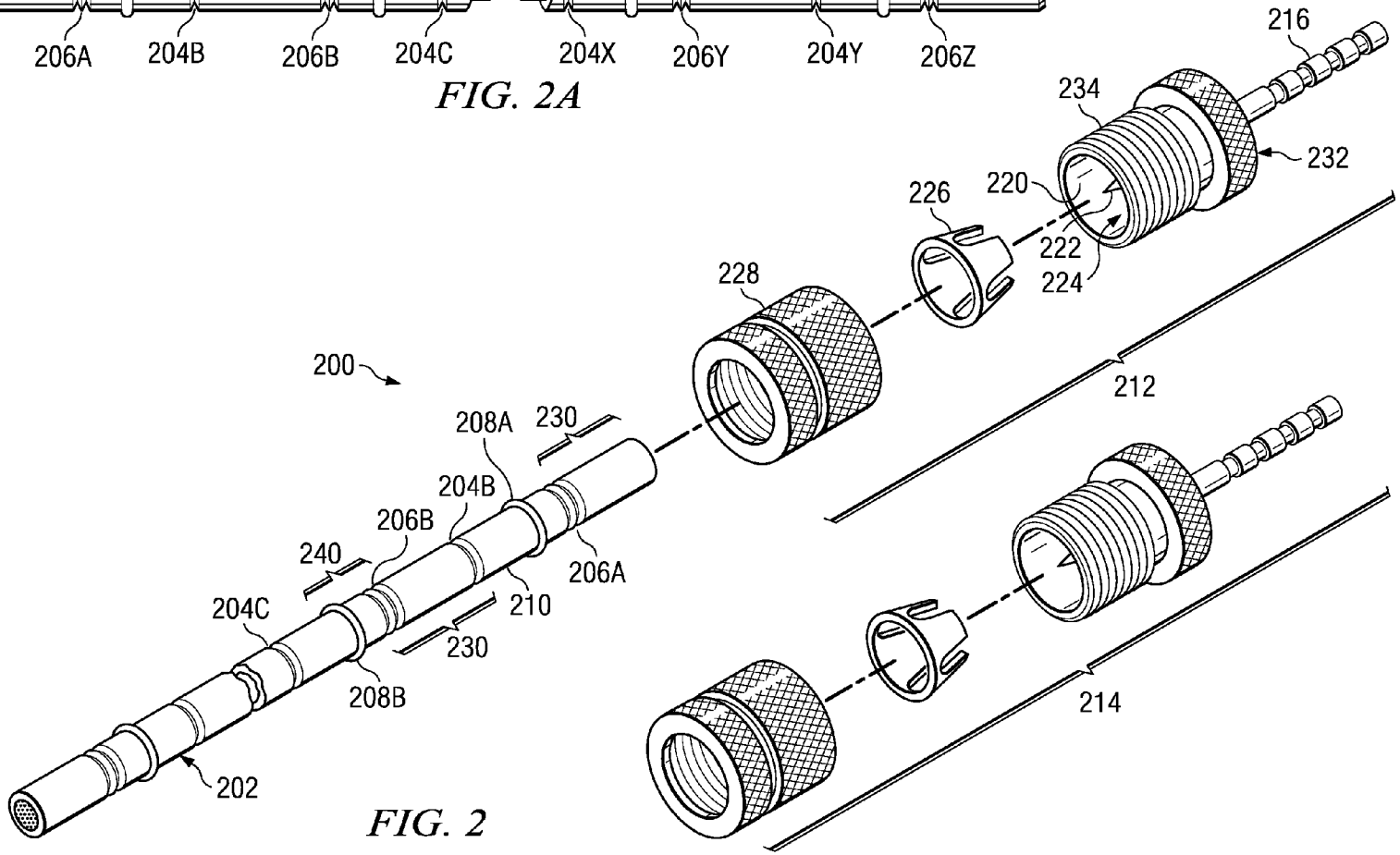
FIG. 2 is an isometric view of a second conductor and connector kit according to the invention.

Another kit 200 according to the invention is shown in FIG. 2. In this embodiment an insulated conductor 202, here shown as being of the multistranded type, has a series of markings $\mathbf{204}_x$, $\mathbf{206}_x$, $\mathbf{208}_x$ which can be sensed (and, preferably distinguished from each other) by touch. These markings can take the form of bumps or indentations in the insulation jacket 210.

The bumps and grooves illustrated herein are all circumferential and further are radially symmetrical, but they could be chosen to be otherwise. Where grooves are used, they should only be deep enough to be sensed and should not exposed the conductive core.

The kit 200 includes at least two end connectors 212 and 214, which in this embodiment are identical to each other. Other kits may be provided in which the connectors, and therefore the cable marking sets on opposite ends of the conductor, are intentionally different from each other. Describing connector 212 by way of example, the connector 212 has, as its conductive connector element to further electrical apparatus, a pin connector 216. The connector 216 axially extends in a first direction from a connector body 218 which has a bore 220 therein. A coaxial center pin 222 extends from a floor (not shown) of the bore 220 toward an opening 224 thereof. The connector 212 further includes a collar 226 and a cap 228, through which the conductor 202 is threaded during the process of terminating the conductor 202 with the connector 212.

The connector 212 is of a kind which does not require the insulation 210 to be stripped from an end of the conductor 210 prior to its insertion through components 228 and 226 and into bore 220. The markings on the exterior of the conductor insulation 210 therefore do not include strip lines. In this embodiment, there are cut lines 204B, 204C, . . . , formed by a single circumferential groove; final insertion markings 206A, 206B, . . . , here formed by a double circumferential groove; and initial insertion markings 208A, 208B, . . . , here formed by a single circumferential bump or ridge. These different kinds of touch-perceptible markings are exemplary only.

As before, the distances between different ones of these markings and the markings next adjacent to them are uniform and are predetermined by the dimensions and structure of the connectors 212, 214 provided to terminate the ends of conductor 202. A length 230 between a cut marking $\mathbf{204}_x$ and a next adjacent final insertion marking $\mathbf{206}_x$ is chosen to be the same as a depth 232 of the bore 220, plus whatever distance the cap 228 extends therebeyond once the cap 228 has begun to be threaded onto the outside threaded cylindrical surface 234 of the connector body 218. A length 240 between any final insertion marking $\mathbf{206}_x$ and a next adjacent initial insertion marking $\mathbf{208}_x$ may be chosen as equal to the depth of bore 220 plus the length of the cap 228 where it is fitted to the end of the connector body 218 but not yet threaded onto same. This mark would be used by the user to make sure that the conductor 202 is fully impaled on the center pin 222 prior to threading on the cap.

The conductor 202 is illustrated in more detail in FIG. 2A. In this illustrated embodiment the sets of markings are reflected about some point 250 along the length of the conductor 202. There should be at least one left-to-right-going set of markings, such as markings 204B, 206B and 208B, and there should be at least one right-to-left-going set of markings, such as markings 204Y, 206Y, 208Y.

In an alternative embodiment, the cut lines $\mathbf{204}_x$ would be merged with the initial insertion markings $\mathbf{208}_{x-1}$. For example, cut line 204C would take the place of and be in the same position as initial insertion marking 208B, and there would be no length of conductor between these two locations. This embodiment would reduce the number of different markings which needed to be used and would provide a more precise fitting of the cut conductor length to the length needed by the application in question. In a further modification that would permit conductor 202 to be marked left-to-right without any point of reflection 250, the cut markings 204 would also serve as the initial insertion markings 208, and each cut marking 204 would be equidistantly flanked by a pair of final insertion markings 206, only one of which would be used in terminating the conductor.

Figure 3A:
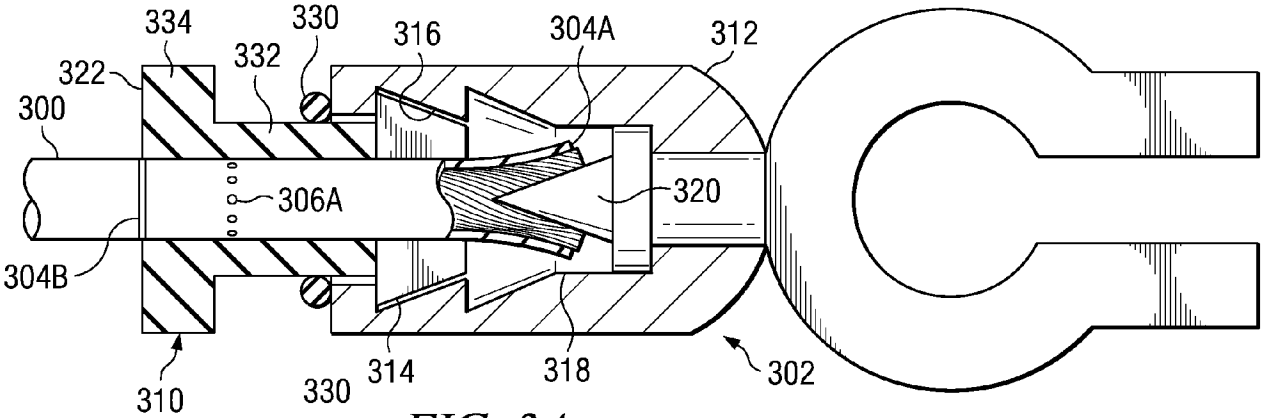
FIGS. 3A and 3B are axial sectional views of an embodiment of the invention employing a nonstripped conductor end and a connector with a compression cap, showing initial and final stages of assembly.
Figure 3B:
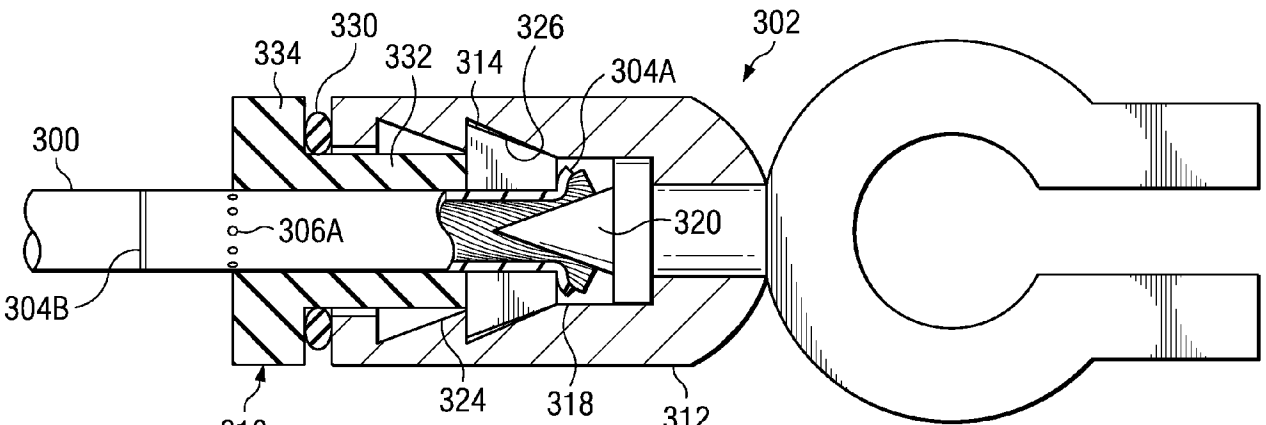

FIGS. 3A and 3B are more detailed illustrations of two stages in the termination of an insulated conductor 300 by a connector 302. The conductor 300 has, along its length, pairs of cut/initial insertion lines 304 and final insertion lines 306. In FIG. 3A, a cap 310 is shown preassembled to a connector body 312 at a first, initial position. This initial position is defined by the interaction of a beveled surface 314 on the cap 310 and a first, mating beveled surface 316 in a bore or receptacle 318 of the connector body 312.

A cut line 304A has been selected by the user as the place to cut the conductor 300. The conductor 300 has then been inserted through a bore of the cap 310 and into the bore 318 of the connector body 318, until it is impaled and spread on an axial, conically shaped conductive element 320. The user knows that the end of the connector 300 has been fully inserted into bore 318 and impaled onto cone 320 by checking that the initial insertion line 304B lines up with an axially outer surface 322 of the cap 310.

In FIG. 3B, a second step in terminating the conductor 300 is shown. In this step, the cap 310 is advanced down the bore 318 of the connector body until the cap beveled surface 314 moves beyond a constriction 324 and "snaps" to a second mating beveled surface 326 in the bore 318. The user will know that this has happened because a final insertion line 306A will be revealed as the cap 310 is slid down bore 318 and is displaced relative to the conductor 300. In this and similar embodiments, the distance between a final insertion line $\mathbf{306}_{x-1}$ (such as line 306A) and the closest initial insertion line $\mathbf{304}_x$ (here, 304*b*) will be determined by a "compression stroke" of the cap 310, or the displacement of cap 310 from the position shown in FIG. 3A to the position shown in FIG. 3B. The distance between the one initial insertion/cut line 304 and the next adjacent initial insertion line 304 is determined by the optimum displacement of the conductor 300 inside the bore 318 once conductor 300 is fully seated onto connective element 320, plus the distance by which the cap 310 protrudes axially outwardly from the entrance of bore 318 when cap 310 is in the first position.

The connector 302 shown in FIGS. 3A and 3B further includes an elastomeric o-ring 330 which rides on a cylindrical or prismatic shaft 332, which in turn extends from beveled surface 314 axially outwardly to an enlarged end 334 of the cap 310. In the position shown in FIG. 3B, the o-ring 330 is axially compressed and forms a seal between the connector body 312 and the enlarged end 334.

Figure 4A:
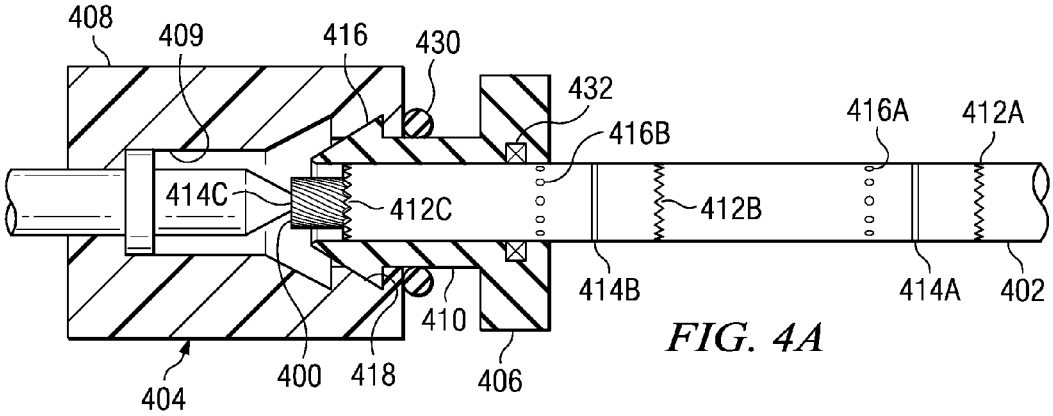
FIGS. 4A-4C are axial sectional views of an embodiment of the invention employing a conductor with a stripped end and a connector with a threaded compression cap, showing three successive stages of assembly.
Figure 4B:
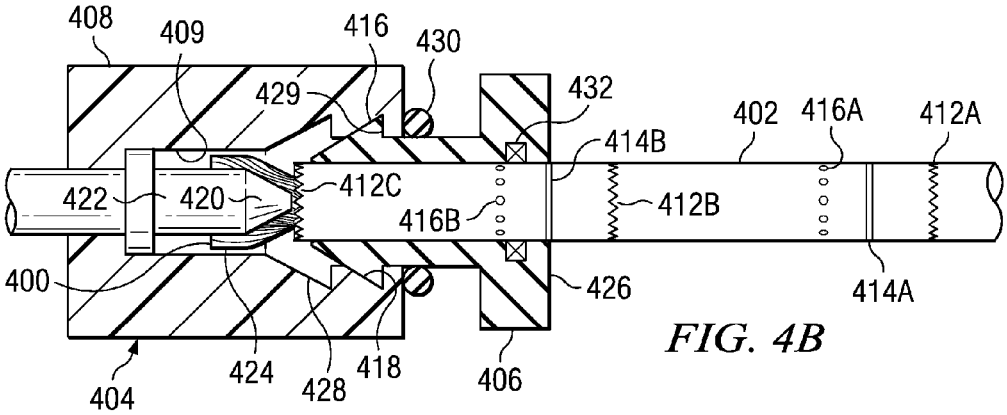
Figure 4C:
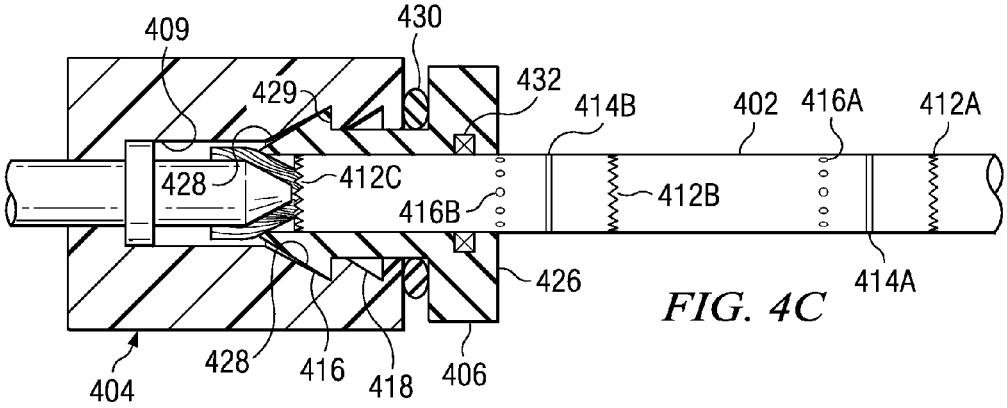

FIGS. 4A-4C illustrate a different embodiment of the invention, this one employing a connection system in which an end 400 of a multistranded insulated conductor 402 is stripped prior to connection. The connector 404 used in this embodiment again employs a cap 406 and a main connector body 408, the latter of which has a bore or receptacle 409 which receives both conductor end 400 and a shaft 410 of the cap 406. The conductor 402 provided for the illustrated connector 404 has repeating sequences of three markings down its length: a set of strip lines 412, a set of cut lines 414 and a set of final insertion lines 416. In FIG. 4A, the conductor has been cut on a cut line 414C (not directly seen anymore, as the insulation bearing this marking has been stripped away, but evident by the fact that the conductor ends at this point) and the insulation has been stripped from that cut line back to a next adjacent strip line 412C. The cap 406 is seen at a first position relative to the connector body 408, in which a beveled surface 416 of the cap 406 mates with a first, axially outward beveled surface 418 of the connector body 408.

In FIG. 4B, the conductor 402 has been slid further into the bore 409 of the connector body 408, such that a terminal cone 420 of an axially disposed conductive element 422 penetrates into about the center of the exposed conductive strands 424. To gauge whether this insertion has gone far enough, the user checks to see if the initial insertion line 414B is lined up with an axially outer surface 426 of the cap 406.

In FIG. 4C, the cap 406 has been compressed axially inwardly relative to the connector body 408 and the conductor 402, advancing from a first position seen in FIG. 4B past a restriction 429 to a second position. The second position is defined by an interior beveled surface 428 of the bore 409, which mates with the cap beveled surface 416. The cap 406 is pushed beyond a bore constriction 429 axially inwardly from the first beveled surface 418 until the cap beveled surface 416 seats with the second bore beveled surface 428. The user will have assurance that this has happened by noticing the appearance of the final insertion line 416B.

In this embodiment, the distance between any cut/initial insertion line $\mathbf{414}_x$ and a next adjacent cut/initial insertion line $\mathbf{414}_{x+1}$ is predetermined to be the same as the sum of the length of the conductor 402 to be inserted into the bore 409, plus the distance by which the cap 406 extends axially outwardly from the entrance of bore 409 when the cap 406 is in the first position. The distance between any cut line $\mathbf{414}_x$ and a next adjacent strip line $\mathbf{412}_x$ is predetermined by the amount of insulation which should be stripped from the conductor end. The distance between any cut/initial insertion line $\mathbf{414}_x$ and the next adjacent final insertion line $\mathbf{416}_x$ is determined by the "compression stroke" of the cap 406 between its initial position, as seen in FIG. 4B, and its final position, as seen in FIG. 4C. In this embodiment, this "compression stroke" is in turn determined by the distance between axially outward beveled surface 418 and axially inward beveled surface 428.

The connector illustrated in FIGS. 4A-4C employs two o-rings or seals: a cap shaft o-ring 430 similar in disposition and function to o-ring 330 shown in FIGS. 3A and 3B, and a cap internal bore o-ring or seal 432 which seals to the insulation of the conductor 402. Of course the invention has equal application to connectors without such o-rings or seals.

Figure 5:
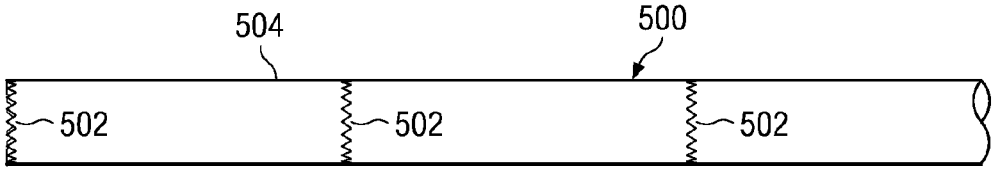
FIGS. 5-10 are side views of marked insulated conductors according to different embodiments of the invention.

FIGS. 5-10 illustrate different kinds and sequences of cable markings according to the invention. In FIG. 5, an insulated wire 500 has a squiggly or wavy line 502 placed on its insulation jacket 504 at uniform predetermined intervals. The lines 502 are used for both cutting and insertion.

Figure 6:
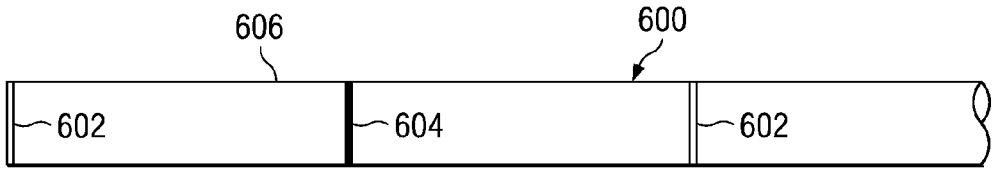

An insulated conductor 600 shown in FIG. 6 has alternating double lines 602 and single lines 604 printed on its insulation jacket 606. The double lines 602, for example, can be used for insertion, while the single lines 604 can be used for cutting.

Figure 7:
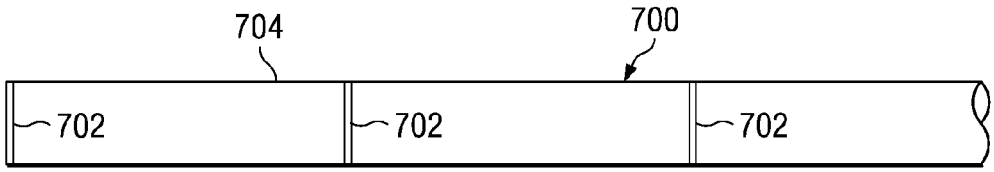

In FIG. 7, an insulated conductor 700 has double lines 702 placed at equally spaced intervals along its insulation jacket 704. Double lines 702 are used for both cutting and insertion.

Figure 8:
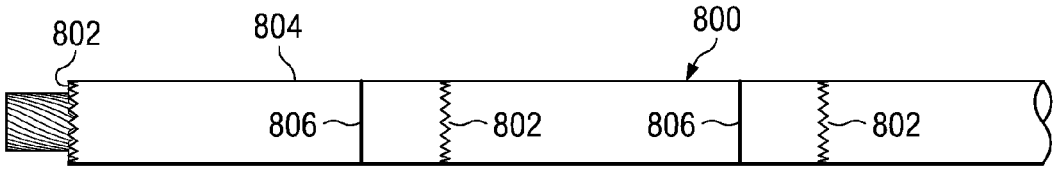

FIG. 8 illustrates an insulated conductor 800 with a series of wavy or squiggly lines 802 placed on its insulation jacket 804, as alternating with ones of a series of straight lines 806. Lines 802 are used as strip lines and are uniformly spaced from respective cut lines 806 by a predetermined strip length. The cut lines 806 are also used for insertion measurements, and are separated from each other by the length of the cable to be inserted into a connector body receptacle, as including that portion of any cap which protrudes therefrom at an initial position.

Figure 9:
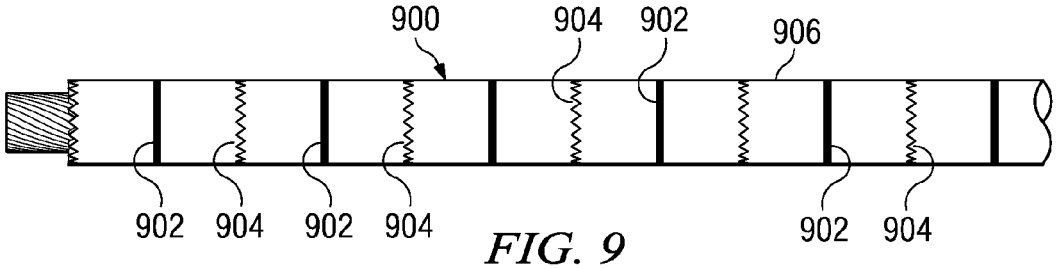

FIG. 9 illustrates a multistranded insulated conductor 900 having alternating straight and wavy lines 902, 904 on its insulation jacket 906. The straight lines 902 are used for cutting, while the wavy or squiggly lines 904 are used for a stripping measurement. Because strip lines 904 are equidistant from the next adjacent cut lines 902, the conductor 900 does not have to have a marking reflection point (as is seen in FIGS. 1A and 2A). Instead, the conductor 900 can be marked using the same sequence all along its length, and the markings will work from either end.

Figure 10:
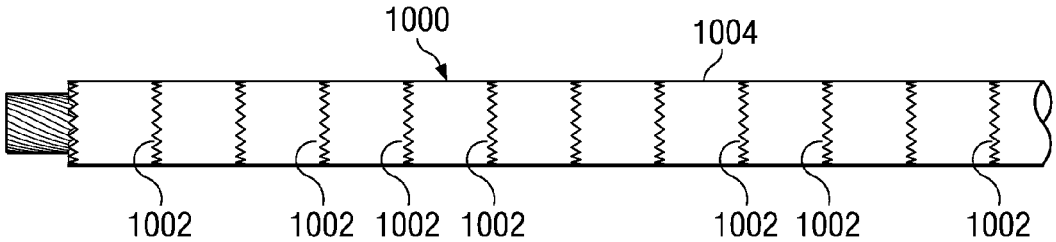

FIG. 10 illustrates an even simpler case, in which a conductor 1000 has a uniformly spaced series of squiggly lines 1002 placed on its insulation jacket 1004. One line 1002 is selected by the user for cutting, and a next adjacent line 1002 is used as a strip line.

Figure 11:
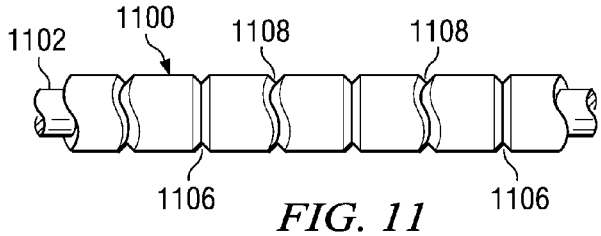
FIG. 11 is a side view of a marked insulated conductor according to the invention in which the markings are perceptible by touch.

FIG. 11 shows an insulated conductor 1100 with a solid core 1102 and an insulation jacket 1104. The marking schemes disclosed herein have equal application to insulated conductors of both the multistranded and solid-core or wire types. Two kinds of markings 1106, 1108 alternate down the length of the conductor 1100. Markings 1106 can, for example, be used as cut lines. Depending on the type of connector with which the cable 1100 is meant to be used, markings 1108 can be used as strip lines or final insertion lines. Both markings 1106 and 1108 are formed as grooves in the insulation jacket, and are made just deep enough to be perceptible by touch. Markings 1106 can be chosen as single circumferential grooves, residing in planes orthogonal to the conductor axis, while markings 1108 can be chosen to take a shape which is clearly distinguishable from the shape used to form markings 1106, such as a sinuous groove. An advantage to using touch-perceptible markings is that the user will have less trouble assembling them to their respective connectors in low-light conditions, an environment often encountered by installers of wire, cable and electrical and electronic components.

Figure 12:
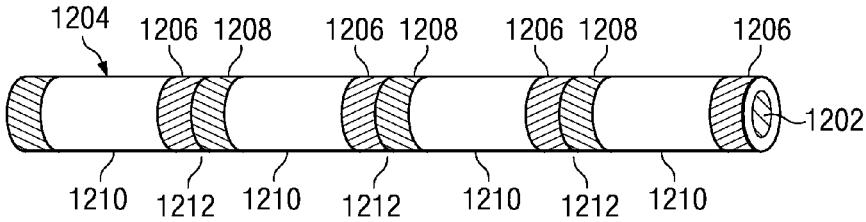
FIG. 12 is a side view of a marked insulated conductor in which the markings are executed as bands of different colors.

FIG. 12 shows an insulated conductor 1200 with a solid core 1202 and an insulation jacket 1204. In the illustrated marking scheme the markings do not take the form of thin linear limits but instead wide colored bands or zones. The jacket 1204 has a set of strip zones 1206 that shown the user how far to strip the wire 1202. Adjoining each strip zone in this embodiment is a final insertion zone 1208, whose length is equal to that of a "compression stroke" of a connector cap between an initial and a final position. Between zone 1208 and the next, unadjoining strip zone 1206 is a zone 1210, which can be left uncolored. A margin 1212 between adjoining strip and final insertion zones 1206, 1208 marks a point at which a user can cut the conductor 1200. The sum of zones 1206, 1210 and 1208 is the same as an initial insertion depth of the connector (not shown) for which the conductor is provided. Instead of using different colors, zones 1206 and 1208 could be distinguished from each other by different surface treatments.

In the illustrated embodiments of the invention, the visual indicators indicating places to cut, strip limits and insertion limits are formed by thin circumferential lines or thick bands (either solid or interrupted, and either entirely linear or wavy) which are substantially in a plane that is orthogonal to the conductor axis. These indicia are conveniently applied as by paint or ink to a (typically polymeric) insulation jacket. But this is not the only way these visual indicia can manifest themselves. In alternative embodiments, the conductor jacket can be made in alternating bands of colored polymer. Some of these bands may be rendered transparent so that the user can see the conductive core.

While FIGS. 1-4C illustrate marked insulated conductors used with electrical connectors, the present invention can also be used in situations in which one or both of the ends of the electrical conductor are terminated directly into or onto electrical or electronic apparatus, such as battery terminals, speaker terminals, amplifier terminals and the like. These situations also commonly involve stripping the insulated conductor end and may also involve optimal receptacle insertion depths.

Figure 13:
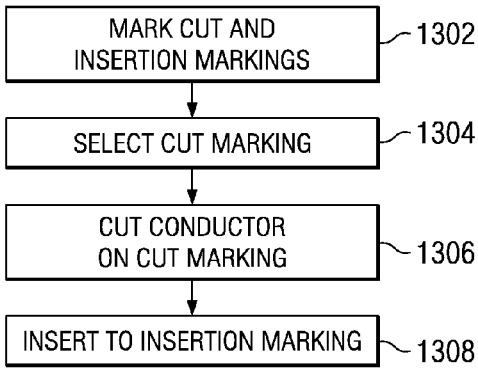
FIGS. 13-15 are flow charts of assembly methods in different embodiments of the invention.

FIG. 13 diagrams steps in a first, basic method according to the invention. In a first, manufacturing step (1302) an insulated wire or cable is marked, in any of the various ways described herein, with cut and insertion markings. Using the marked, insulated wire or cable, the user selects (1304) at least one of the cut markings to cut the conductor to a length suitable for connecting together two electronic components or the like. At step 1306, the user cuts the conductor as these point(s). Then, at step 1308, the user inserts the cut conductor into a receptable of a connector body, until the insertion marking next adjacent the conductor end lines up with a reference, such as the axially outward face of a connector cap (see, e.g., FIG. 3A).

Figure 14:
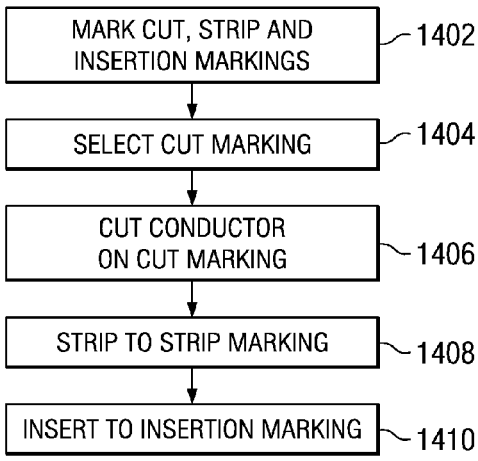

In an alternative method diagrammed in FIG. 14, in an initial insulated conductor manufacturing step (1402) the conductor insulation is marked, by any of the ways described herein, with cut, strip and insertion markings. This alternative method is for a connector type that receives a stripped wire or cable end. As before, the user selects (1404) a cut marking on the conductor insulation and cuts (1406) the conductor to length at this point. The user then (1408) strips the insulation from the cut end back to the next adjacent strip marking. Finally, the user inserts (1410) the cut and stripped end into a receptacle of the connector for which this conductor has been provided, until the insertion marking lines up with some predetermined visual reference, assuring the user that the right amount of conductor length has been inserted into the connector.

Figure 15:
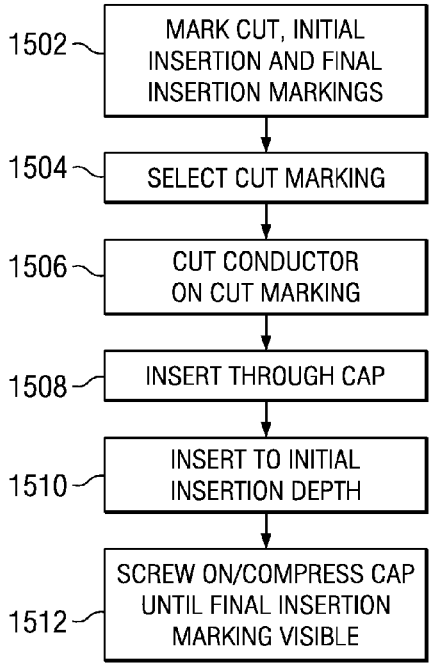

A third method for using the invention is diagrammed in FIG. 15. In this embodiment, a conductor will be terminated by a connector that has a compression cap (such as those seen in FIGS. 1, 2, 3A and 3B) which compresses into the connector from an initial position to a final position. At an initial, manufacturing stage 1502, the insulation of the conductor is marked, in one of the ways described herein, with cut, initial insertion and final insertion markings. At step 1504 the user selects at least one of the cut markings and, at step 1506, cuts the conductor to a desired length at the selected cut marking. The cut end is then inserted (1508) through the connector's compression cap and into the connector body to an initial insertion depth (1510), such that the initial insertion marking lines up with some predetermined visual reference, such as the axially outward face of the compression cap when that cap is in a first position. At step 1512, and depending on the way the cap is joined to the connector body, the cap is screwed on, compressed, or otherwise moved from a first, initial position to a second, final position, at which point the connector is satisfactorily joined to the conductor in terms of electrical conductance, physical strain relief and/or electrical insulation from the surrounding environment. The user knows that this has been done adequately because a final insertion marking will become visible.

In summary, different schemes for marking the jackets of insulated conductors have been shown and described. The markings provide convenient indicia for cutting, stripping, initial insertion into a connector, and compression using a cap which articulates (screws on, compresses into) the rest of a connector body. The present invention simplifies or obviates the need for separate measuring devices, printed instructions or the like and promotes terminations of conductors which are physically and electrically uniform one to the next.

While illustrated embodiments of the present invention have been described and illustrated in the appended drawings, the present invention is not limited thereto but only by the scope and spirit of the appended claims.

I claim:

1. An electrical connection kit, comprising:

at least one electrical connector having a connector body, the body including a conductor receptacle, a predetermined insertion depth for the electrical connector defined as a function of an extent to which an insulated conductor is to be inserted into the receptacle; and a length of insulated conductor having a conductive core and an insulation jacket surrounding the core, the insulation jacket having, spaced along its length, a plurality of cut markings, the insulation jacket further having a plurality of insertion markings uniformly spaced from respective ones of the cut markings by said insertion depth, such that a user may cut the conductor at a selected cut marking and have an indicium of how far the cut conductor is to be inserted into the electrical connector;

the electrical connector further having a cap with a bore for receiving the insulated conductor therethrough, the cap capable of being assembled to the connector body in a first position, the insertion markings on the insulation jacket being initial insertion markings, a selected one of the initial insertion markings being used by a user as an indicium to show how far a cut conductor should be inserted through the bore in the cap and into the receptacle of the connector body;

the insulation jacket further having a plurality of final insertion markings spaced from respective ones of the initial insertion markings by a uniform predetermined length, the user, after threading a cut conductor through the cap and inserting the cut conductor into the receptacle in the connector body, moving the cap from the first position to a second position on the connector body by using the final insertion marking next adjacent to the last said initial insertion marking to determine whether the cap is correctly assembled to the female connector body.

2. The kit of claim 1, wherein the initial and final insertion markings are visually distinguishable from each other.

3. The kit of claim 1, wherein the initial and final insertion markings distinguishable from each other by the sense of touch.

4. The kit of claim 1, wherein the initial and final insertion markings are visually distinguishable from each other.

5. The kit of claim 1, wherein the initial and final insertion markings are distinguishable from each other by sense of touch.

6. The kit of claim 1, wherein the conductor has a reflection point dividing the length of the conductor into first and second parts, a first sequential order of the cut markings and the insertion markings appearing on the first part the length of the conductor, a second sequential order which is the reverse of the first sequential order appearing on the second part of the length of the conductor.

7. The kit of claim 1, and further comprising a second connector similar to said electrical connector, the second connector and said electrical connector provided for terminating opposed ends of the electrical conductor.

8. An electrical connection kit, comprising:

at least one electrical connector having a connector body, the body including a conductor receptacle, a predetermined insertion depth for the electrical connector defined as a function of an extent to which an insulated conductor is to be inserted into the receptacle;

a length of insulated conductor having a conductive core and an insulation jacket surrounding the core, the insulation jacket having, spaced along its length, a plurality of cut markings, the insulation jacket further having a plurality of insertion markings uniformly spaced from respective ones of the cut markings by said insertion depth, such that a user may cut the conductor at a selected cut marking and have an indicium of how far the cut conductor is to be inserted into the electrical connector;

wherein the electrical connector has a cap with a bore for receiving the insulated conductor therethrough, the cap preassembled to the connector body at a first position, the cap movable into the receptacle of the connector body from the first position to a second position by a predetermined compression stroke, the connector body and cap preassembled thereto at the first position together defining an initial insertion depth, said insertion markings being initial insertion markings spaced from respective ones of the cut markings by said initial insertion depth; and a plurality of final insertion markings along the length of the insulated conductor, each final insertion marking spaced from a next adjacent initial insertion marking by said compression stroke.

9. The kit of claim 8, wherein the initial and final insertion markings are visually distinguishable from each other.

10. The kit of claim 8, wherein the initial and final insertion markings distinguishable from each other by the sense of touch.

11. The kit of claim 8, wherein the conductive core is selected from the group consisting of solid wire and multistranded cable.

12. An insulated conductor, comprising:

an elongate conductive core;

an insulation jacket radially surrounding the conductive core;

a plurality of cut markings on the insulation jacket spaced from each other along a length of the conductor; and a plurality of insertion markings on the insulation jacket spaced from each other along the length of the conductor, each insertion marking spaced from a respective cut marking by an insertion depth predetermined as a function of a depth of a receptacle of an electrical connector into which a cut end of the electrical connector is adapted to be inserted;

wherein the insertion markings on the insulation jacket are initial insertion markings, a selected one of the initial insertion markings being used by a user as an indicium to show how far a cut conductor should be inserted through a cap of the connector and into the receptacle of the connector body;

the insulation jacket further having a plurality of final insertion markings spaced from respective ones of the initial insertion markings by a uniform predetermined length, the user, after inserting the cut conductor through the cap and into the receptacle in the female connector body, assembling the cap to the female connector body by using the final insertion marking next adjacent to the initial insertion marking to determine whether the cap is correctly assembled to the connector body.

13. The insulated conductor of claim 12, wherein the initial and final insertion markings are visually distinguishable from each other.

14. The insulated conductor of claim 12, wherein the initial and final insertion markings are distinguishable from each other by the sense of touch.

15. An insulated conductor, comprising:

an elongate conductive core;

an insulation jacket radially surrounding the conductive core;

a plurality of first sets of cut and insertion markings on the insulation jacket spaced from each other along a length of the conductor, each first set comprising at least one cut marking and at least one insertion marking, the cut and insertion markings in each first set having a first sequential order; and a plurality of second sets of cut and insertion markings on the insulation jacket spaced from each other along the length of the conductor, each second set comprising at least one cut marking and at least one insertion marking, the cut and insertion markings in each second set having a second sequential order opposite the first sequential order, each insertion marking spaced from a respective cut marking by an insertion depth predetermined as a function of a depth of a receptacle of an electrical connector into which a cut end of the electrical connector is adapted to be inserted;

wherein at least one insertion marking of each set is an initial insertion marking, a selected one of the initial insertion markings being used by a user as an indicium to show how far a cut conductor should be inserted through a cap of the connector and into the receptacle of the connector body;

wherein at least one insertion marking of each set is a final insertion marking spaced from the initial insertion marking of the set by a uniform predetermined length, the user, after inserting the cut conductor through the cap and into the receptacle in the female connector body, assembling the cap to the female connector body by using the final insertion marking next adjacent to the initial insertion marking to determine whether the cap is correctly assembled to the connector body;

wherein a reflection point along the length of the conductor divides the length of the conductor into a first part and a second part, the plurality of first sets of cut markings and insertion markings appearing of the first part of the length of the conductor, and the plurality of second sets of cut markings and insertion markings appearing on the second part of the length of the conductor.

16. The insulated conductor of claim 15, wherein the conductive core is selected from the group consisting of solid wire and multistranded cable.

17. The insulated conductor of claim 15, wherein the cut markings and insertion markings are visually distinguishable from each other.

18. The insulated conductor of claim 15, wherein the cut markings and insertion markings are distinguishable from each other by sense of touch.

19. The insulated conductor of claim 15, and further including a plurality of strip markings spaced from each other along the length of the conductor, each strip marking spaced from a respective cut marking by a predetermined strip length through which the insulation jacket is to be removed by the user from an end of the conductor prior to termination of the last said end by the electrical connector.

20. The insulated conductor of claim 19, wherein the strip markings are visually distinguishable from the cut markings.

21. The insulated conductor of claim 19, wherein the strip markings are distinguishable from the cut markings by sense of touch.

22. A method for connecting an insulated electrical conductor to an electrical connector having a cap and a receptacle defining a predetermined insertion depth into which an insulated conductor is to be inserted into the connector, the method comprising the steps of:

marking, on an insulation jacket of the insulated conductor, a plurality of cut markings;

marking, along the length of the insulation jacket at a uniform distance from respective ones of the cut markings, a plurality of insertion markings, the uniform distance being equal to the predetermined insertion depth;

cutting the conductor at a selected cut marking to create a conductor free end;

inserting the free end of the conductor into the receptacle until a next adjacent insertion marking lines up with an edge of the receptacle; and using the cap to complete the connection of the conductor to the connector.

23. The method of claim 22, and further comprising the steps of:

creating the cut markings to be the same as the insertion markings, the cut markings being uniformly spaced from each other by said insertion depth;

selecting a first of the cut markings to mark where the insulated conductor is to be cut; and using a next adjacent one of the cut markings on the insulated conductor as an insertion marking.

24. The method of claim 22, and further comprising the step of creating the cut markings and the insertion markings to be visually distinct from each other.

25. The method of claim 22, and further comprising the step of creating the cut markings and the insertion markings to be distinct from each other to the touch.

26. The method of claim 22, and further comprising the steps of:

creating a plurality of strip markings along the length of the insulated conductor, the strip markings spaced from respective ones of the cut markings by a uniform strip length;

cutting the insulated conductor at a selected one of the cut markings;

stripping the insulation from the conductor from a cut end thereof to a next adjacent strip marking; and inserting the stripped end of the insulated conductor into the receptacle of the connector using the insertion marking next adjacent the selected cut marking to as a guide to determine whether the conductor has been inserted into the receptacle by the correct amount.

27. The method of claim 26, and further comprising the step of creating the strip markings to be visually distinct from the cut markings.

28. The method of claim 26, and further comprising the step of creating the strip markings to be distinct from the cut markings according to the sense of touch.

29. The method of claim 22, wherein the insertion markings are initial insertion markings, the method further comprising the steps of:

creating a plurality of final insertion markings along the length of the insulated conductor, each final insertion marking spaced from a respective initial insertion marking by a predetermined length;

threading the free end of the insulated conductor through the cap of the connector;

inserting the free end of the insulated conductor into the receptacle in the connector, using the initial insertion marking next adjacent to the cut marking as a guide to determine a correct amount of insertion; and affixing the cap to the connector, said step of affixing including using the final insertion marking to determine a correct degree of affixation such that a complete connection to the insulated conductor is made.

30. The method of claim 29, and further comprising the step of creating the final insertion markings to be visually distinct from the initial insertion markings.

31. The method of claim 29, and further comprising the step of creating the final insertion markings to be distinct from the initial insertion markings according to the sense of touch.

32. The method of claim 22, wherein the insertion markings are initial insertion markings, the method further comprising the steps of:

creating a plurality of final insertion markings along the length of the insulated conductor, each final insertion marking uniformly spaced from an initial insertion marking by a uniform compression stroke;

preassembling the cap to a first position relative to the connector;

inserting a free end of the connector through the cap and into the receptacle in the connector, using the initial insertion marking next adjacent the selected cut marking as a guide to determine a correct amount of insertion; and advancing the cap from the first position relative to the connector to a second position spaced from the first position to complete the connection to the insulated conductor, said step of advancing including using the final insertion marking next adjacent the last said initial insertion marking as a guide to ensure that the cap has been sufficiently advanced.

33. The method of claim 32, and further comprising the step of creating the final insertion markings to be visually distinct from the initial insertion markings.

34. The method of claim 32, and further comprising the step of creating the final insertion markings to be distinct from the initial insertion markings according to the sense of touch.

* * * * *